US005561442A

United States Patent [19]

Okada et al.

[11] Patent Number: 5,561,442

[45] Date of Patent: Oct. 1, 1996

[54] METHOD AND CIRCUIT FOR DRIVING A DISPLAY DEVICE

[75] Inventors: Hisao Okada, Nara-ken; Toshihiro Yanagi, Nara; Yuji Yamamoto, Kobe, all of Japan

[73] Assignee: Sharp Kabushiki Kaisha, Osaka, Japan

[21] Appl. No.: 543,695

[22] Filed: Oct. 16, 1995

Related U.S. Application Data

[63] Continuation of Ser. No. 219,281, Mar. 28, 1994, abandoned.

[30] Foreign Application Priority Data

Apr. 1, 1993 [JP] Japan ..... 5-076009

[51] Int. Cl.[6] ..... G09G 3/36

[52] U.S. Cl. ..... 345/94; 345/58; 345/208

[58] Field of Search ..... 345/58, 63, 89, 345/92, 94, 208; 359/58, 59

[56] References Cited

U.S. PATENT DOCUMENTS

| | | | |
|---|---|---|---|
| 4,870,396 | 9/1989 | Shields | 345/92 |
| 4,909,602 | 3/1990 | Kaneko et al. | 345/92 |
| 5,296,847 | 3/1994 | Takeda et al. | 345/58 |
| 5,379,050 | 1/1995 | Annis et al. | 345/58 |

FOREIGN PATENT DOCUMENTS

| | | | |
|---|---|---|---|
| 0336570 | 11/1989 | European Pat. Off. | 345/92 |
| 3168617 | 7/1991 | Japan | 345/98 |

OTHER PUBLICATIONS

"Capacitively Coupled driving of TFT–LCD" SID, 1989 pp. 242–245.

"10.4 in.–Diagonal color TFT–LCDs without Residual Images" SID, 1990 Digest, pp. 408–411.

"A Large, Full–color TFT–LCD system for multi–media applications" ITEJ Technical Report vol. 16 No. 11 pp. 67–72.

H. Okada et al. "P2–12 An 8.4–in. TFT–LCD System for A Note–Size Computer Using 3–Bit Digital Data Drivers", Japan Display '92, pp. 475–478.

*Primary Examiner*—Richard Hjerpe
*Assistant Examiner*—Amare Mengistu
*Attorney, Agent, or Firm*—Nixon & Vanderhye P.C.

[57] ABSTRACT

A method for driving a display device including a display medium; a pair of substrates opposed to each other and interposing the display medium therebetween; a common electrode provided on one of the pair of substrates; and a switching element, a scanning electrode for applying a voltage for controlling the switching element to be in one of an ON state and an OFF state, and a signal electrode for applying a voltage in accordance with image data to the display medium, all of which are provided on the other substrate of the pair of substrates. The method includes the steps of driving the common electrode by a voltage represented by a first function which indicates a waveform of a voltage for driving the common electrode and uses time as a variable; and driving the scanning electrode by a voltage represented by a second function which indicates a waveform of a voltage for driving the scanning electrode and uses time as a variable, in the state where a primary differential of the first function and a primary differential of the second function are equal to each other when the switching element is in the OFF state

5 Claims, 7 Drawing Sheets

*Fig. 6* *(Prior Art)*
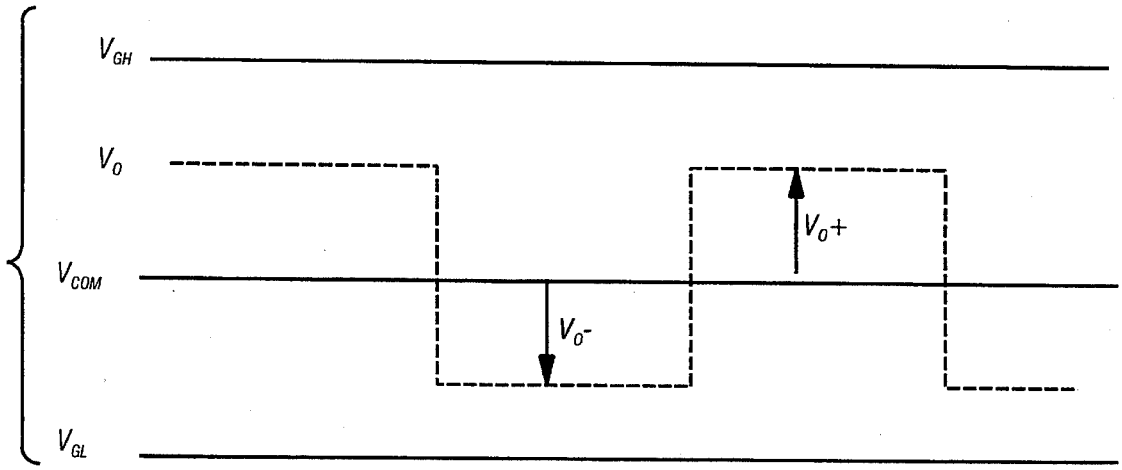
*Fig. 7* *(Prior Art)*
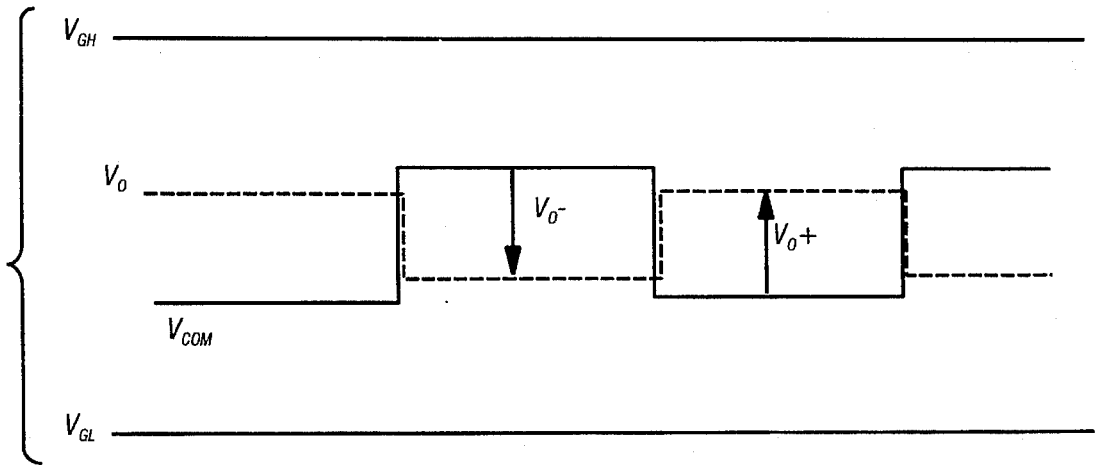

*Fig. 8* *(Prior Art)*
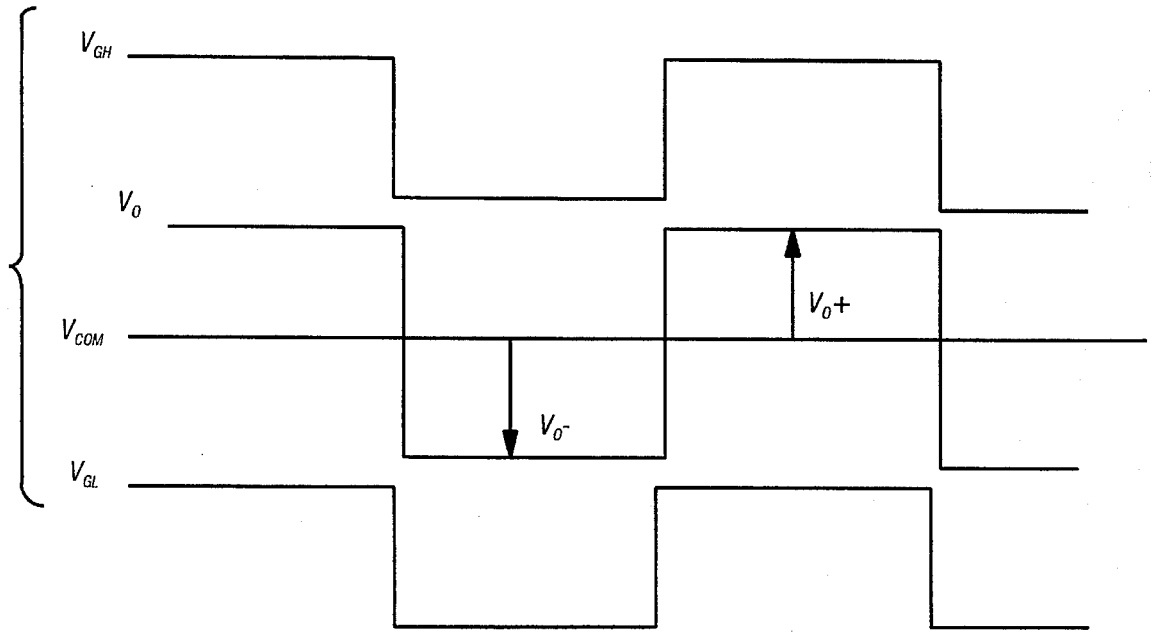

METHOD AND CIRCUIT FOR DRIVING A DISPLAY DEVICE

This is a File-Wrapper Continuation of application Ser. No. 08/219,281, filed Mar. 28, 1994, now abandoned.

BACKGROUND OF THE INVENTION

1. Field of the Invention

The present invention relates to a method and a device for driving a display device of an active matrix system, especially of a liquid crystal display device.

2. Description of the Related Art

A liquid crystal display device (hereinafter, referred to as the "LCD device") of an active matrix system includes a display panel having an active matrix substrate on which pixel electrodes each as a display unit are formed in a matrix. The display panel further includes a counter substrate opposed to the active matrix substrate and a display medium such as a liquid crystal provided therebetween. The counter electrode includes a common electrode opposed to the pixel electrodes. The active matrix substrate includes a plurality of scanning electrodes (each provided as a scanning line or a gate line) located parallel to each other and a plurality of signal electrodes (each provided as a signal line or a source line) located parallel to each other and perpendicular to the scanning electrodes. Each of the pixel electrodes is formed in an area enclosed by two adjacent scanning electrodes and two adjacent signal electrodes, and connected to the corresponding signal electrode via a switching element (for example, a thin film transistor; hereinafter, referred to as the "TFT") and connected to the corresponding scanning electrode via a gate. The common electrode usually includes a single conductive layer opposed to all the pixel electrodes. A pixel includes a pixel electrode, an area of the common electrode opposed to the pixel electrode, a switching element, and an area of the display medium corresponding to the pixel electrode. The pixel may include a storage capacitor to improve display quality.

In such an LCD device, the state of the display medium provided between the active matrix substrate and the counter substrate is optically changed by applying a voltage between at least one of the pixel electrodes and an area of the common electrode opposed to the pixel electrode, and thus display is performed.

Methods for driving the common electrode are generally classified into two. One is a method using a DC voltage, and the other is a method using an AC voltage having a reference voltage as a central voltage.

Briefly referring to FIG. 6, the driving method of the common electrode using a DC voltage will be described. FIG. 6 illustrates the relationship among waveforms of a voltage $V_{COM}$ for driving the common electrode, an ON voltage $V_{GH}$ of the scanning electrode, an OFF voltage $V_{GL}$ of the scanning electrode, and a voltage $V_0$ for driving the signal electrode used to apply a maximum voltage to the liquid crystal. Driving which is performed using a DC voltage both for the ON voltage and the OFF voltage of the scanning electrode is referred to as the "DC voltage driving of the scanning electrode". In FIG. 6, $V_0^+$ indicates a voltage applied to the liquid crystal when the pixel electrode is charged positively with respect to the common electrode (namely, the potential difference between the voltages $V_0$ and $V_{COM}$). $V_0^-$ indicates a voltage applied to the liquid crystal when the pixel electrode is charged negatively with respect to the common electrode (namely, the potential difference between the voltages $V_{COM}$ and $V_0$). The time when the pixel electrode is charged positively with respect to the common electrode is referred to as the "positive time", and the time when the pixel electrode is charged negatively with respect to the common electrode is referred to as the "negative time". The absolute values of the voltages $V_0^+$ and $V_0^-$ are approximately equal to each other. In such a case, a signal line driver (data driver) is required to have an output dynamic range of $|V_0^+|+|V_0^-|$.

Briefly referring to FIG. 7, the driving method of the common electrode using an AC voltage will be described. FIG. 7 illustrates the relationship among waveforms of the voltage $V_{COM}$ for driving the common electrode, the ON voltage $V_{GH}$ of the scanning electrode, the OFF voltage $V_{GL}$ of the scanning electrode, and the voltage $V_0$ for driving the signal electrode used to apply a maximum voltage to the liquid crystal. FIG. 8 illustrates the voltages $V_{GH}$, $V_{GL}$ and $V_0$ with respect to the voltage $V_{COM}$ (namely, the potential difference between each of the first three voltages and the voltage $V_{COM}$). As is apparent from FIG. 8, in the driving method using an AC voltage, an output dynamic range of the signal line driver can be expanded by the difference between the high level and the low level of the voltage $V_{COM}$. In other words, the output dynamic range of the signal line driver can be narrowed by the above-mentioned difference. This is advantageous in, for example, enhancing the driving speed of the signal line driver, reducing production cost, and reducing power consumption when the LCD device is used as a module. Accordingly, the driving method using an AC voltage is widely used today.

In a conventional driving method of the common electrode using an AC voltage, the ON voltage $V_{GH}$ and the OFF voltage $V_{GL}$ of the scanning electrode are both a DC voltage as is illustrated in FIG. 7. Accordingly, with respect to the common electrode, the ON voltage $V_{GH}$ and the OFF voltage $V_{GL}$ of the scanning electrode are both an AC voltage as is illustrated in FIG. 8. This is not a serious problem in the case of, for example, a conventional LCD device using TFTs in which one of two electrodes of the storage capacitor is formed on the common electrode, since the degree of deterioration of the display quality is low. In such a storage capacitor, the opening ratio (the ratio of an area for transmission therethrough of light with respect to a display area) is lowered by the storage capacitor. However, the reduction in such a ratio is not a serious problem in the conventional LCD device without very high display protection.

As the display device has been enlarged and the display precision has been enhanced in recent years, an absolute area of each pixel has been reduced and an area which does not transmit light such as a switching element such as a TFT, a scanning electrode and a signal electrode has been enlarged. As a result, the whole image plane is more and more darkened, which proposes a serious problem. In order to solve this problem, a structure in which the storage capacitor is formed on the scanning electrode (Cs-ON gate structure) is adopted to avoid adverse influence of the storage capacitor on the luminance. In this structure, one of the electrodes of the storage capacitor is, for example, connected to the scanning electrode or connected to an independent electrode formed at an end of a display panel using an independent wire provided for the storage capacitor. If the scanning electrode is driven by a DC voltage in such structure, the display quality is drastically deteriorated to possibly propose a serious problem in the practical use of the LCD device.

In order to restrict such deterioration of the display quality to a minimum extent, a floating gate driving method was developed. Hereinafter, the floating gate driving method will be briefly described with an example of a case of 3 bits and 8 gray levels (data 0 through data 7) with reference to FIGS. 9 through 11.

FIG. 9 illustrates an example of waveforms of driving voltages obtained by the floating gate driving method. $V_{COM}$ indicates a voltage for driving the common electrode. $V_0$ and $V_7$ indicate the voltage of a gray-level power supply of a signal electrode driving circuit for data 0 and data 7, respectively. $V_{GH}$ and $V_{GL}$ indicates an ON voltage supplied by an ON voltage supply circuit and an OFF voltage supplied by an OFF voltage supply circuit of a scanning electrode driving circuit, respectively. As is apparent from the waveforms of the voltages $V_0$, $V_7$, $V_{GH}$, $V_{GL}$ and $V_{COM}$, the signal electrode, the scanning electrode and the common electrode are all driving by an AC voltage using a certain voltage as a central voltage in this method. Voltages $V_1$ through $V_6$ of other gray-level power supplies of the signal electrode driving circuit respectively corresponding to data 1 through data 6 depend on a voltage between the voltages $V_0$ and $V_7$. The voltages $V_{GH}$ and $V_{GL}$ are set to have a waveform having an equal amplitude.

FIG. 10 illustrates the voltages $V_0$, $V_7$, $V_{GH}$, and $V_{GL}$ relative to the voltage $V_{COM}$ (namely, the potential difference between each of the first four voltages and the voltage $V_{COM}$). As is apparent from FIG. 10, the display panel obtains the same effects in the case when the common electrode, the gray-level power supplies, and the scanning electrode are driven by the floating gate driving method and in the case when these electrodes are driven by the conventional method in which the common electrode is driven by a DC voltage and the gray-level power supplies and the scanning electrode are driven so that the voltages $V_0$, $V_7$, $V_{GH}$ and $V_{GL}$ have the same relationship as the relationship shown in FIG. 10.

FIG. 11 is a circuit diagram of a conventional floating gate driving circuit, which is known. In the floating gate driving method, the scanning electrode driving circuit and a power supply for the circuit (scanning electrode means) is entirely separated from the other electric systems when a DC current flows, and the power supply for the scanning electrode driving circuit rides on the waveform on the driving voltage of the common electrode. As is illustrated in FIG. 11, a control signal $G_{SF}$ (scanning start pulse) and a control signal $G_{CK}$ (scanning clock pulse) which are to be supplied to the scanning electrode driving circuit are separated from a control signal generating circuit and supplied to the scanning electrode driving circuit as a control signal $G_{SP}'$ and a control signal $G_{CK}'$. An output from a common electrode driving circuit 101 including an operational amplifier (not shown) is supplied to the scanning electrode driving circuit as an ON voltage $V_{GH}$, an OFF voltage $V_{GL}$ and driving supply voltages for elements of a logic system via a transformer 102. A voltage $V_s$ is, for example, a supply voltage of +5 V or more, and the control signals $G_{SP}$ and $G_{CK}$ have a level between, for example, +5 V and the ground.

Conventionally, photocouplers 103 or the like are required to separate the control signals $G_{SP}$ and $G_{CK}$ from the other electric systems. Provision of the photocouplers 103 makes the structure of the floating gate driving circuit complicated and causes a rise in production cost. Further, the theory concerning the floating gate driving method is qualitative, as is apparent from FIGS. 9 and 10. For these reasons, the floating gate driving method has not been actively developed.

Moreover, as the display panels have been improved in display precision and enlarged in size, problems of the circuit such as shown in FIG. 11 have become serious. Practically, the load characteristics of the display panel has been become larger than before. Accordingly, a waveform of the voltage for driving the common electrode, a waveform of the driving voltage actually applied to the common electrode in the display panel, and a waveform of the voltage for driving the scanning electrode driving circuit have become more and more distorted. As a result, the display quality is deteriorated. Further, the voltage of the pixel electrode of the display panel is influenced by the distortion of the waveform of the voltage for driving the common electrode. This undesirably causes slight fluctuations in the gray level.

SUMMARY OF THE INVENTION

A driving method according to the present invention drives a display device includes a display medium; a pair of substrates opposed to each other and interposing the display medium therebetween; a common electrode provided in one of the pair of substrates; and a switching element, a scanning electrode for applying a voltage for controlling the switching element to be in one of an ON state and an OFF state, and a signal electrode for applying a voltage in accordance with image data to the display medium, all of which are provided on the other substrate of the pair of substrates. The method includes the steps of driving the common electrode by a voltage represented by a first function which indicates a waveform of a voltage for driving the common electrode and uses time as a variable; and driving the scanning electrode by a voltage represented by a second function which indicates a waveform of a voltage for driving the scanning electrode and uses time as a variable, in the state where a primary differential of the first function and a primary differential of the second function are equal to each other when the switching element is in the OFF state.

Alternatively, a driving method according to the present invention drives a display device including a display medium; a pair of substrates opposed to each other and interposing the display medium therebetween; a common electrode provided on one of the pair of substrates; a switching element, a scanning electrode for applying a voltage for controlling the switching element to be in one of an ON state and an OFF state, and a signal electrode for applying a voltage in accordance with image data to the display medium, all of which are provided on the other substrate of the pair of substrates; a storage capacitor provided electrically parallel to the display medium; and a storage capacitance electrode for applying a voltage to the storage capacitor. The method includes the steps of driving the common electrode by a voltage represented by a first function which indicates a waveform of a voltage for driving the common electrode and uses time as a variable; driving the scanning electrode by a voltage represented by a second function which indicates a waveform of a voltage for driving the scanning electrode and uses time as a variable; and driving the storage capacitance electrode by a voltage represented by a third function which indicates a waveform of a voltage for driving the storage capacitance electrode and uses time as a variable, in the state where a primary differential of the first function, a primary differential of the second function, and a primary differential of the third function are equal to one another when the switching element is in the OFF state.

In one embodiment of the invention, the method includes the step of detecting a voltage applied to one of the common electrode and the scanning electrode; and equalizing the voltage for driving the one of the common electrode and the scanning electrode with the voltage applied to the one of the common electrode and the scanning electrode, based on the detected voltage.

In another aspect of the invention, a circuit for driving a display device according to the present invention includes a display medium; a pair of substrates opposed to each other and interposing the display medium therebetween; a common electrode provided on one of the pair of substrates; a switching element, a scanning electrode for applying a voltage for controlling the switching element to be one of an ON state and an OFF state, and a signal electrode for applying a voltage in accordance with image data to the display medium, all of which are provided on the other substrate of the pair of substrates; a common electrode driving voltage supply for sending a driving voltage having a waveform represented by a first function which uses time as a variable to the common electrode; a scanning electrode driving voltage supply for sending a driving voltage having a waveform represented by a second function which uses time as a variable to the scanning electrode; and an adjusting circuit for adjusting the voltage sent by one of the common electrode driving voltage supply and the scanning electrode driving voltage supply to equalize a primary differential of the first function with a primary differential of the second function.

In one embodiment of the invention, the circuit includes a detection circuit for detecting a voltage applied to one of the common electrode and the scanning electrode and sending the detected voltage to one of the common electrode driving voltage supply and the scanning electrode driving voltage supply which corresponds to the one of the common electrode and the scanning electrode in order to equalize the driving voltage sent by the one of the common electrode driving voltage supply and the scanning electrode driving voltage supply with the voltage applied to the one of the common electrode and the scanning electrode.

Thus, the invention described herein makes possible the advantages of providing a method and a circuit for driving a display device based on a thorough theoretical reasoning to reproduce a high quality visual image with no fluctuation in gray level.

These and other advantages of the present invention will become apparent to those skilled in the art upon reading and understanding the following detailed description with reference to the accompanying figures.

BRIEF DESCRIPTION OF THE DRAWINGS

FIG. 6 is a waveform diagram illustrating driving voltages obtained in the case of driving a common electrode using a DC voltage.

FIG. 7 is a waveform diagram illustrating driving voltages obtained in the case of driving the common electrode using an AC voltage.

FIG. 8 is a waveform diagram illustrating the driving voltages shown in FIG. 7 relative to a voltage for driving the common electrode.

DESCRIPTION OF THE PREFERRED EMBODIMENTS

Figure 1:
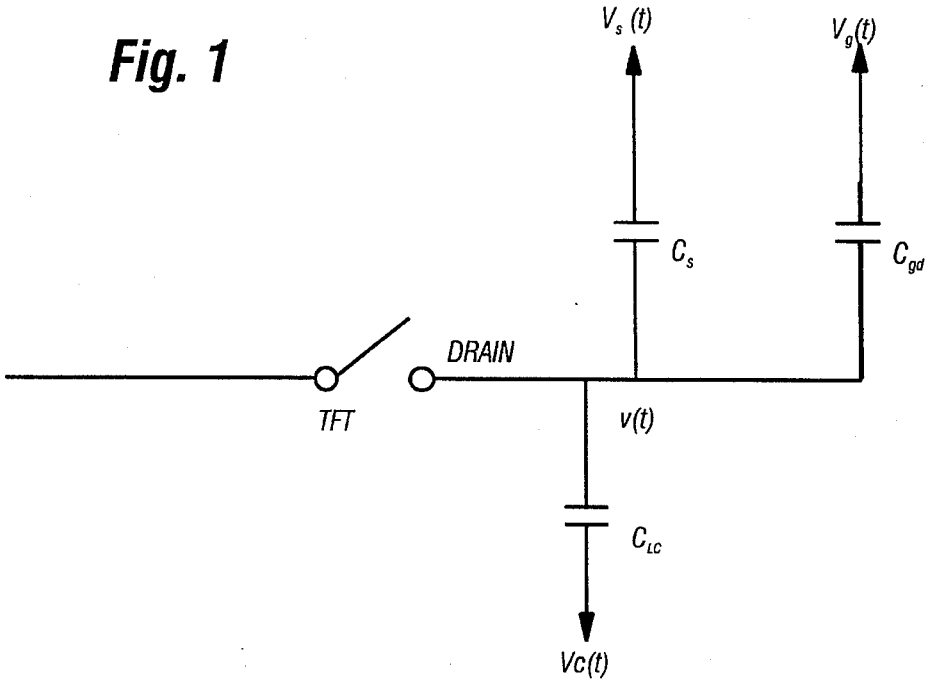
FIG. 1 is an equivalent circuit diagram of a pixel of a display device for theoretical reasoning on which the present invention is based.

FIG. 1 is an equivalent circuit diagram of a pixel of a display device for reasoning of the theory on which the present invention is based.

Where the capacitance of the pixel is $C_{LC}$, the storage capacitance is $C_s$, and the floating capacitance between the gate electrode and the drain electrode of a TFT used in the circuit in $C_{gd}$, the charge amount generated at the pixel is $q_{LC}$, the charge amount generated at the source electrode of the TFT is $q_s$, and the charge amount generated at the gate electrode and the drain electrode is $q_{gd}$, the charge amounts $q_{LC}$, $g_s$, and $q_{gd}$ are expressed by Equations (1). The gate electrode of the TFT is connected to the scanning electrode of the display device, and the source electrode is connected to the signal electrode.

$$\begin{aligned} q_{LC} &= C_{LC}\{V(t)-V_c(t)\} \\ q_s &= C_s\{V(t)-V_s(t)\} \\ q_{gd} &= C_{gd}\{V(t)-V_g(t)\} \end{aligned} \tag{1}$$

Since the circuit shown in FIG. 1 is a closed circuit, Equation (2) is fulfilled.

$$q_{LC}+q_s+q_{gd}=\text{const 1} \tag{2}$$

where const 1 is a constant.

From Equations (1) and (2), Equation (3) is obtained.

$$C_{LC}\{V(t)-V_c(t)\}+C_s\{V(t)-V_s(t)\}+C_{gd}\{V(t)-V_g(t)\}=\text{const 1} \tag{3}$$

Since the potential difference between the pixel electrode and the common electrode determine the gray level, the potential difference should be constant in order to avoid the fluctuation in gray level. Such a condition is expressed by Equation (4).

$$V(t)-V_c(t)=\text{const 2} \tag{4}$$

where const 2 is a constant.

By substituting Equation (4) into Equation (3) and differentiating Equation (3) for time t, Equation (5) is obtained.

$$C_s\{V'(t)-V_s'(t)\}+C_{gd}V'(t)-V_g'(t)\}=0 \tag{5}$$

In a display device with no storage capacitor, $C_s=0$. Accordingly, the fluctuation in gray level can be solved by fulfilling Equation (6).

$$V'(t)=V_g'(t) \quad (6)$$

From Equation (4), Equation (7) is fulfilled. Accordingly, Equations (6) and (8) are equivalent to each other.

$$V'(t)=V_c'(t) \quad (7)$$

$$V'_g(t)=V_c'(t)' \quad (8)$$

Equation (8) indicates that the display quality is maintained high by driving the scanning electrode and the common electrode so that the primary differential of a function indicating the driving voltage of the scanning electrode using time as a variable is equal to the primary differential of a function indicating the driving voltage of the common electrode and using time as a variable when the switching element is OFF. (A function which uses time as a variable will be referred to as a "time function".)

In a display device provided with a storage capacitor, the sufficient condition to solve the fluctuation in gray level is fulfilling Equation (9), from Equation (5).

$$V'(t)=V_s'(t)$$

$$V'(t)=V_g'(t) \quad (9)$$

From Equation (7), Equations (9) are equivalent to Equation (10).

$$V_s'(t)=V_c'(t)$$

$$V_g'(t)=V_c'(t) \quad (10)$$

Equations (10) indicate that the display quality is maintained high by driving the scanning electrode, the common electrode and a storage capacitance electrode so that the primary differential of a time function indicating the driving voltage of the scanning electrode and the primary differential of a time function indicating a driving voltage of the storage capacitance electrode are each equal to the primary differential of a time function indicating the driving voltage of the common electrode when the switching element is OFF.

In the case when the storage capacitor is formed on the scanning electrode (Cs-ON gate structure), Equation (11) is fulfilled. Accordingly, the fluctuation in gray level is solved by fulfilling Equation (12).

$$V_s(t)=V_g(t) \quad (11)$$

$$V_g'(t)=V_c'(t) \quad (12)$$

Equation (12) indicates that the display quality is maintained high by driving the scanning electrode and the common electrode so that only the primary differential of a time function indicating the driving voltage of the scanning electrode is equal to the primary differential of a time function indicating the driving voltage of the common electrode when the switching element is OFF.

Equations (13) are obtained by integrating Equation (10).

$$V_s(t)=V_c(t)+\text{const } 3$$

$$V_g(t)=V_c(t)+\text{const } 4 \quad (13)$$

where const 3 and const 4 are constants.

The fact that primary differentials of a plurality of functions are equal to each other is equivalent to the fact that the integrals of the functions are equal to each other except for constants. Accordingly, Equations (13) indicate that the display quality is maintained high by driving the scanning electrode, the common electrode and the storage capacitance electrode so that the waveform of the driving voltage of the scanning electrode and the waveform of the driving voltage of the storage capacitance electrode each correspond with the waveform of the driving voltage of the common electrode except for DC voltage components. In the case when the storage capacitor is formed on the scanning electrode, the display quality is maintained high only by driving the scanning electrode and the common electrode so that the waveform of the driving voltage of the scanning electrode corresponds with the waveform of the driving voltage of the common electrode except for the DC voltage components.

Hereinafter, the present invention will be described by way of illustrative examples with reference to the accompanying drawings.

EXAMPLE 1

Figure 2:
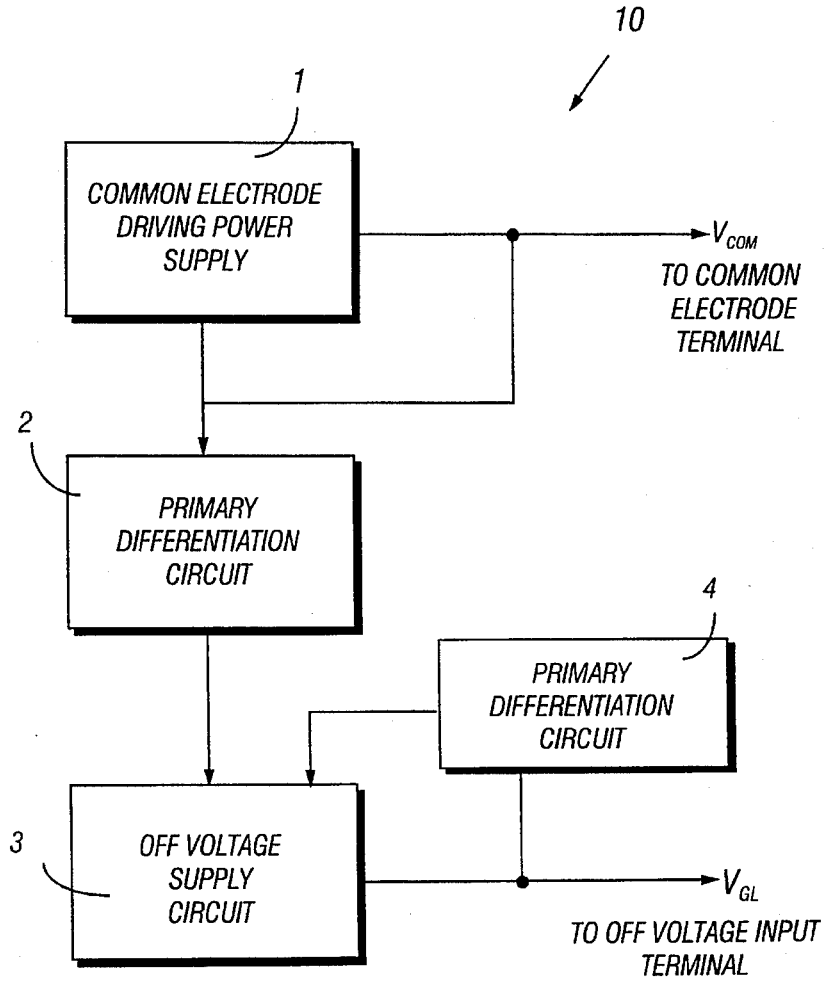
FIG. 2 is a block diagram of a driving circuit for driving a display device with no storage capacitor in a first example according to the present invention.
Figure 3:
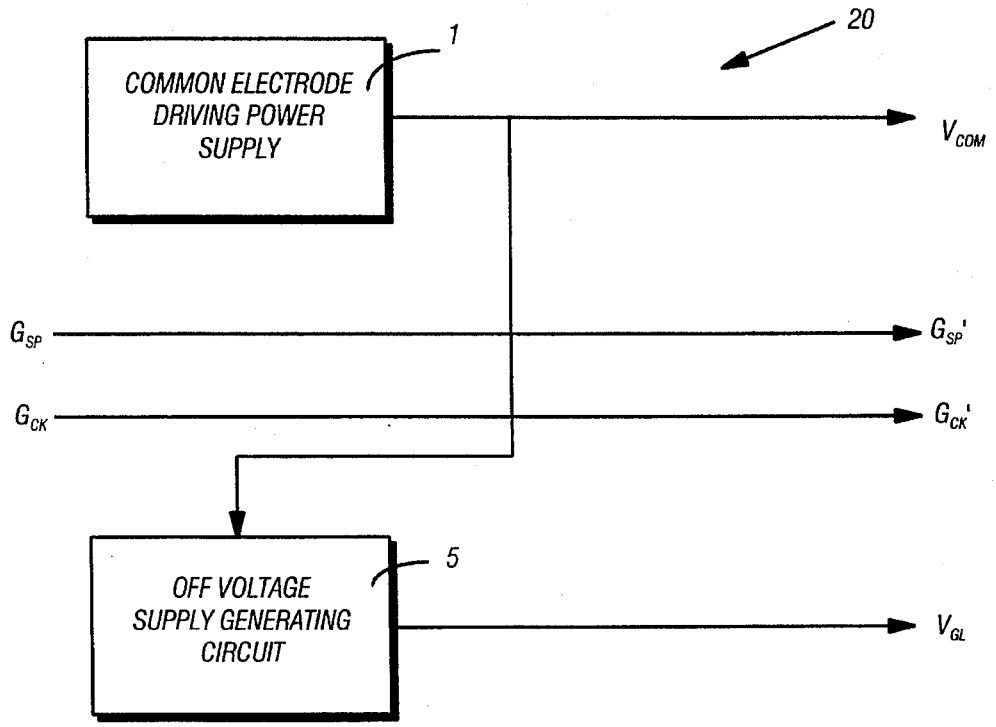
FIG. 3 is a block diagram of a scanning electrode driving circuit including the driving circuit shown in FIG. 2 for the driving method in the first example.
Figure 4:
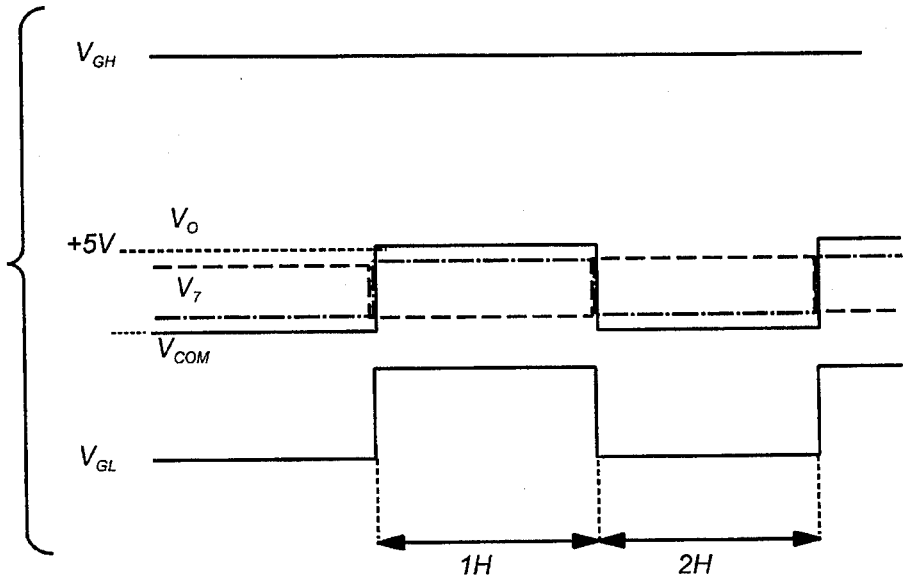
FIG. 4 is a waveform diagram illustrating waveforms of driving voltages obtained by a driving method in the first example.

With reference to FIGS. 2 through 4, a driving method and a driving circuit in a first example according to the present invention will be described. FIG. 2 is a block diagram of a driving circuit 10 for driving a display device (not shown) with no storage capacitor in the first example.

As is shown in FIG. 2, the driving circuit 10 includes a common electrode driving power supply 1 for driving a common electrode of the display device and an OFF voltage supply circuit 3 for supplying the OFF voltage to a scanning electrode.

In the first and the following second examples, $V_{COM}$ indicates a voltage for driving the common electrode. $V_{GH}$ and $V_{GL}$ indicate an ON voltage supplied by an ON voltage supply circuit (not shown) and an OFF voltage supplied by the OFF voltage supply circuit 3, the ON voltage and the OFF voltage both being sent to the scanning electrode.

An output from the common electrode driving power supply 1 is sent to the OFF voltage supply circuit 3 through a primary differentiation circuit 2, and an output from the OFF voltage supply circuit 3 is fed back to the OFF voltage supply circuit 3 through another primary differentiation circuit 4. Due to such structure, the waveform of the driving voltage $V_{COM}$ of the common electrode as the output from the common electrode driving power supply 1 and the waveform of the OFF voltage $V_{GL}$ of the scanning electrode as an output from the OFF voltage supply circuit 3 correspond with each other. As the primary differentiation circuits 2 and 4, a CR differentiation circuit having the simplest structure may be used although various other types of circuits may also be used instead of the CR differentiation circuit.

FIG. 3 is a block diagram of a scanning electrode driving circuit 20 including the driving circuit 10 (FIG. 2).

In FIG. 3, an OFF voltage supply generating circuit 5 includes the OFF voltage supply circuit 3 and the primary differentiation circuits 2 and 4. In the method according to the present invention, control signals $G_{SP}$ and $G_{CK}$ can be used as control signals $G_{SP}'$ and $G_{CK}'$ without using a level conversion circuit including a photocoupler or the like. In other words, since it is not necessary to float the scanning electrode driving circuit 20, it is not necessary to electrically separate a control signal generating circuit (not shown) for generating the control signals $G_{SP}$ and $G_{CK}$ from the scanning electrode driving circuit 20.

In the scanning electrode driving circuit 20, among the ON voltage supply circuit for supplying the ON voltage to the scanning electrode, the OFF voltage supply circuit 3 for supplying the OFF voltage to the scanning electrode, and a power supply (not shown) for driving a logic element of the scanning electrode driving circuit 20, only the OFF voltage supply circuit 3 includes the circuit shown in FIG. 2. It is not necessary that the other two circuits have the structure shown in FIG. 2. Accordingly, one power supply can be used both as the power supply for driving the logic element and a power supply of the control signal generating circuit, and thus the control signal generating circuit can directly be connected to the logic element.

According to the method for driving the display device in the first sample according to the present invention, the structure of the driving circuit of the display panel can be significantly simplified. Therefore, production cost can be greatly reduced without adversely influencing the display quality, and the reliability of the display device can be improved.

FIG. 4 illustrates an example of waveforms of the voltages $V_{COM}$, $V_{GH}$, $V_{GL}$, $V_0$ and $V_7$ in the scanning electrode driving circuit 20. $V_0$ and $V_7$ indicate a voltage of a gray-level power supply of a signal electrode driving circuit for data 0 and data 7, respectively, obtained in the case of 3 bits and 8 gray levels.

As is illustrated in FIG. 4, by the driving method in the first example, the ON voltage $V_{GH}$ is a DC voltage. The fluctuation in gray level which is generated after the TFT is turned off and the voltage of the pixel is determined to a certain level is eliminated, thereby improving the display quality. The method in the first example contributes to improvement in the display quality during a time period when an image is displayed by a pixel, namely, a time period from the time when the TFT is turned off until the time when the TFT is turned on again, expressed by: (one vertical time period)–(one horizontal time period).

The waveform of the ON voltage $V_{GH}$ influences the voltage of the pixel when the TFT is turned from an "ON" state to an OFF state, but does not directly influence the display quality when the TFT is in the OFF state. In the case when the ON voltage $V_{GH}$ is used as a function, an optimum waveform should be selected for the ON voltage $V_{GH}$ in consideration of conditions for turning the TFT from the ON state to the OFF state, the characteristics of the TFT, and the like.

FIG. 4 illustrates the waveforms which are obtained in the case when the polarity of the charge to the liquid crystal is inverted very horizontal time period H, but the method according to the present invention is not limited to such a case. In essence, when a common electrode is driven by a voltage having a function representing a certain waveform, the common electrode should be driven so that the primary differential (or the change ratio) of the function is equal to the primary differential of a function representing the waveform of a voltage of an OFF voltage $V_{GL}$ supplied by the OFF voltage supply circuit 3 of the scanning electrode. The reason why the common electrode is driven by a function representing such a waveform is irrelevant.

Next, a method for driving a display device provided with a storage capacitor will be described.

In such a case, as is described above, the scanning electrode, a storage capacitance electrode, and the common electrode are driven so that the primary differential of a time function indicating the driving voltage of the scanning electrode and the primary differential of a time function indicating the driving voltage of the storage capacitance electrode are each equal to the primary differential of a time function indicating the driving voltage of the common electrode when the switching element such as a TFT is "OFF". In this manner, the fluctuation in gray level is not generated and the display quality is maintained high.

Accordingly, a driving circuit for driving the display device provided with a storage capacitor includes, in addition to the OFF voltage supply circuit 3 shown in FIG. 2, a circuit for supplying a driving voltage to the storage capacitance electrode and primary differential circuits corresponding to the primary differential circuits 2 and 4.

In the case when the storage capacitor is formed on the scanning electrode, the display quality is maintained high only by driving the scanning electrode and the common electrode so that the primary differential of the time function indicating the driving voltage of the scanning electrode is equal to the primary differential of the time function indicating the driving voltage of the common electrode when the TFT is OFF. Accordingly, the circuit for supplying a driving voltage to the storage capacitance electrode is unnecessary.

EXAMPLE 2

Figure 5:
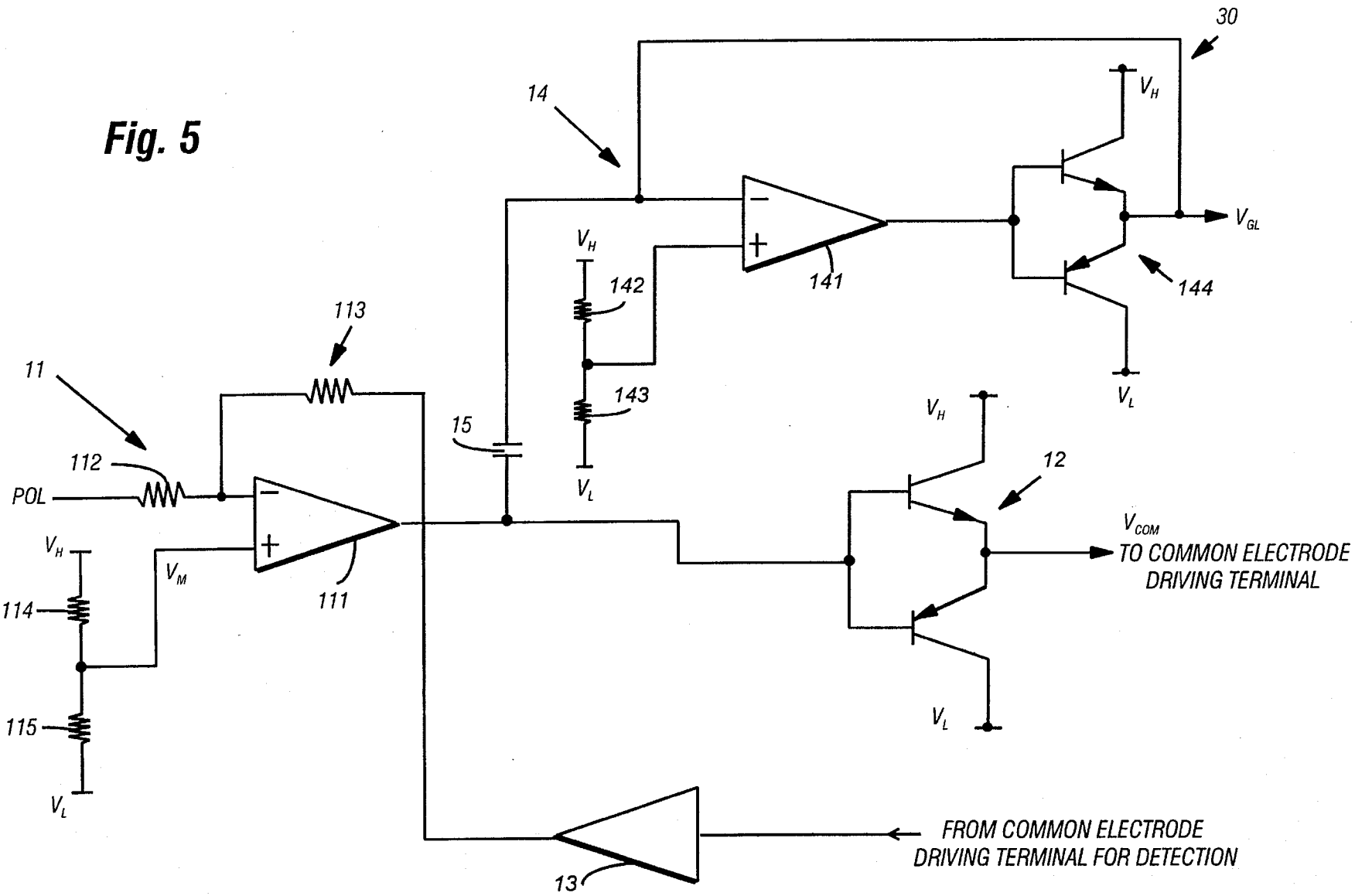
FIG. 5 is a circuit diagram of a driving circuit for driving a display device in a second example according to the present invention.
Figure 9:
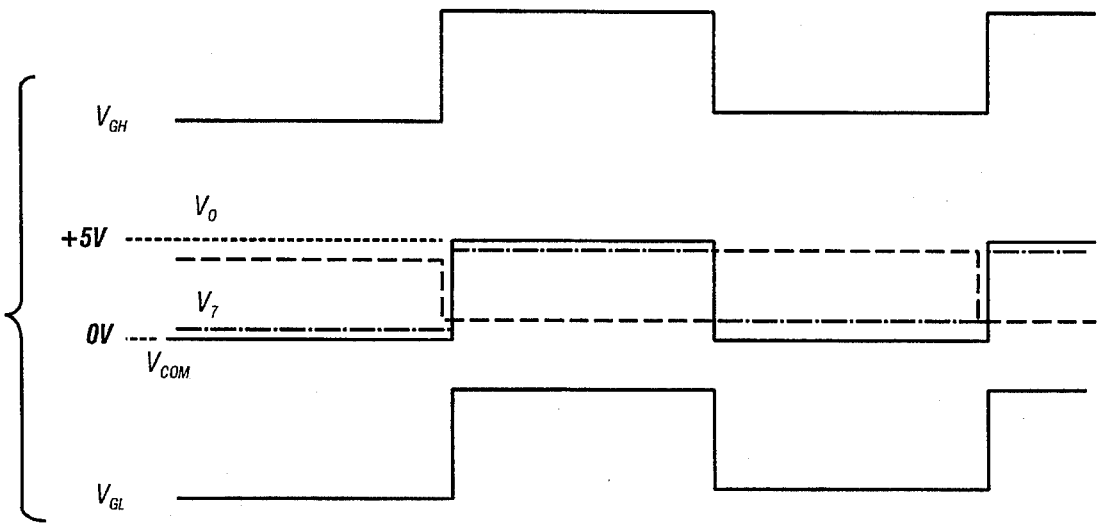
FIG. 9 is a waveform diagram illustrating waveforms of driving voltages obtained by a conventional floating gate driving method.
Figure 10:
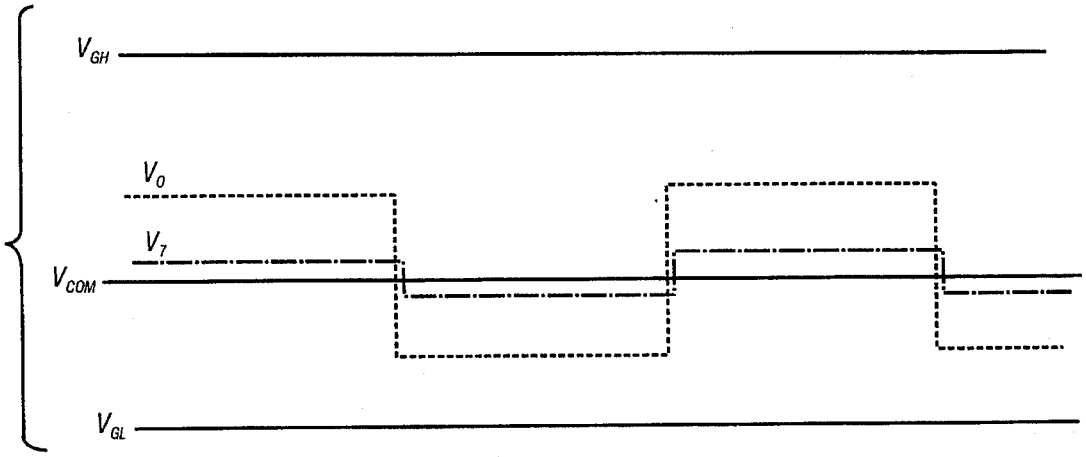
FIG. 10 is a waveform diagram illustrating the driving voltages shown in FIG. 9 relative to a voltage for driving the common electrode.
Figure 11:
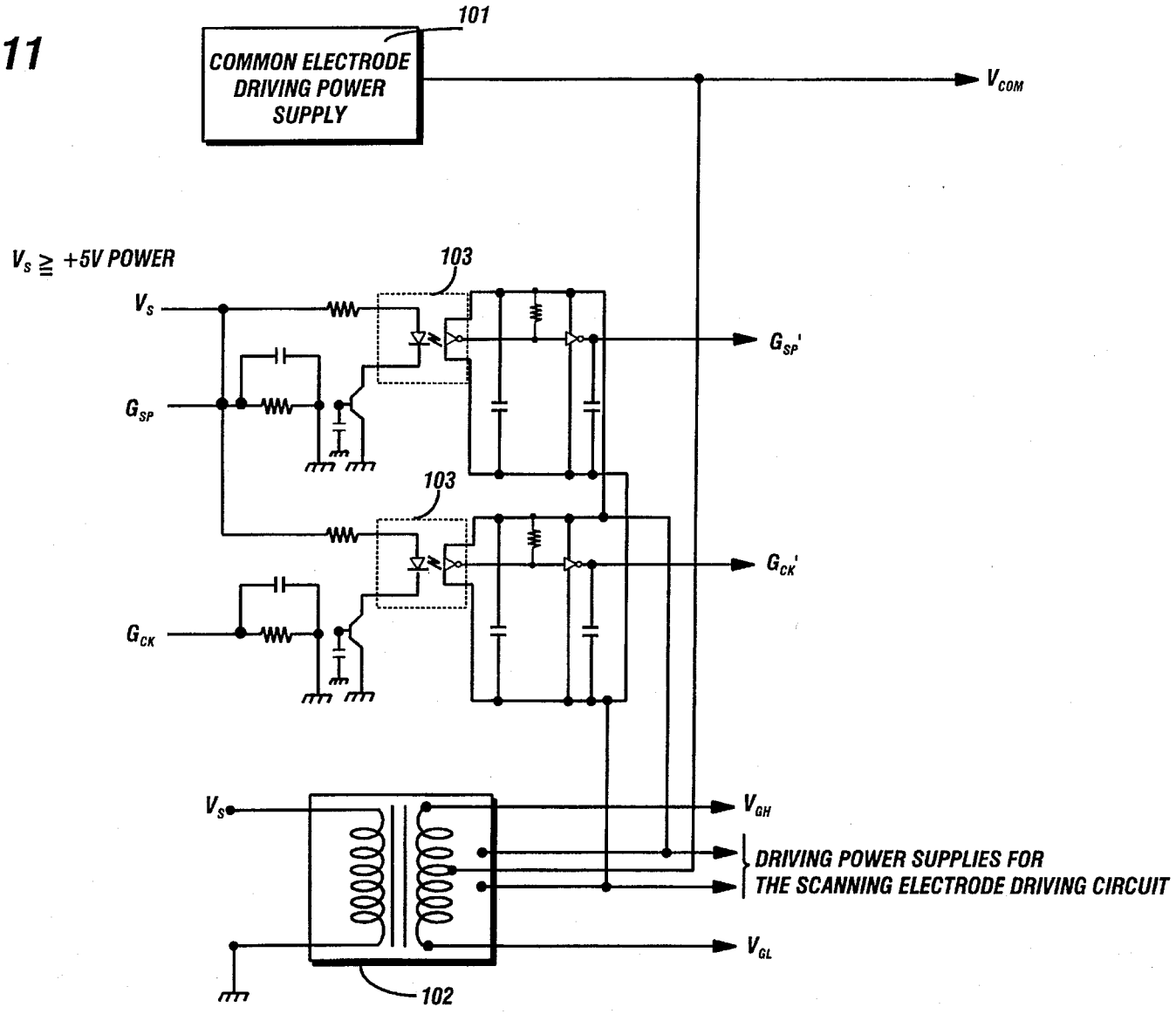
FIG. 11 is a circuit diagram of a scanning electrode driving circuit used by the conventional floating gate driving method.

With reference to FIG. 5, a driving method and a driving circuit in a second example according to the present invention will be described. FIG. 5 is a circuit diagram of a driving circuit 30 for driving a display device in the second example.

The driving circuit 30 includes a reference voltage generating circuit 11 for receiving an input signal POL and generating a reference voltage, a common electrode driving voltage supply 12 for receiving the reference voltage and outputting a voltage $V_{COM}$ for driving the common electrode, a detector 13 for detecting the waveform of the voltage $V_{COM}$, and a voltage buffer circuit 14 connected to an output of the reference voltage generating circuit 11 through a capacitor 15.

The reference voltage generating circuit 11 includes an amplifier 111. The input signal (line inversion pulse signal) POL is inputted to an inverting input of the amplifier 111 through a resistance 112. A non-inverting input of the amplifier 111 is connected between resistance 114 and 115. The resistances 114 and 115 are connected between two voltages $V_H$ and $V_L$ having different levels ($V_H > V_L$).

An output from the reference voltage generating circuit 11 is inputted to the common electrode driving voltage supply 12, and an output $V_{COM}$ from common electrode driving voltage supply 12 is sent to a common electrode driving terminal. The common electrode driving terminal is connected to the detector 13 including an analog buffer having a high input impedance. An output for the detector 13 is fed back to the inverting input of the amplifier 111 through a resistance 113. In this manner, in the driving circuit 30, a part of the output from the common electrode driving terminal is used for detection of the waveform of a voltage actually applied to the common electrode.

The voltage buffer circuit 14 includes an amplifier 141. The output from the reference voltage generating circuit 11 is also inputted to an inversion input of the amplifier 141 through the capacitor 15. A non-inversion input of the amplifier 141 is connected between the resistances 142 and 143. The resistances 142 and 143 are connected between voltages $V_H$ and $V_L$. An output from the amplifier 141 is inputted to a complementary circuit 144 connected between voltages $V_H$ and $V_L$. An output from the complimentary circuit 144, namely, an output from the voltage buffer circuit 14 is inputted to an OFF voltage input terminal.

In the driving circuit 30 in the second example, only an AC component of the output from the reference voltage generating circuit 11 is taken out using the capacitor 15, and a DC component is added to the AC component by the resistances 142 and 143 which are included in the voltage buffer circuit 14.

In the driving circuit 30, in addition to driving the common electrode, the feedback is performed so that a waveform of the output from the voltage buffer circuit 14 which determines at least the OFF voltage $V_{GL}$ of the scanning electrode corresponds with the waveform of the driving voltage $V_{COM}$ for driving the common electrode except for DC components. Accordingly, in the driving circuit 30, the waveform of the voltage $V_{COM}$ and the waveform of the OFF voltage $V_{GL}$ both correspond with the waveform of the voltage reference voltage. In other words, the primary differential of a function representing the waveform of the voltage $V_{COM}$ and the primary differential of a function representing the OFF voltage $V_{GL}$ are equal to each other. As a result, the cause of the fluctuation in gray level is eliminated.

Further in the second example, the waveform of the voltage $V_{COM}$ can be nearly approximated with the waveform of the reference voltage. Therefore, a shadowing phenomenon which occurs when an output supplied to the signal electrode influences the common electrode and thus the voltage $V_{COM}$ for driving the common electrode does not correspond with the voltage actually applied to the common electrode can be avoided.

As has been described, in a driving method and a driving circuit according to the present invention, even with a highly precise display device, high quality display with extremely little fluctuation of gray level in an image displayed by a pixel is realized. Moreover, the shadowing phenomenon can be avoided, thereby further improving the display quality.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A method for driving a display device including:

a display medium;

a pair of substrate opposed to each other and interposing the display medium therebetween;

a common electrode provided on one of the pair of substrates; and a switching element, a scanning electrode for applying a voltage for controlling the switching element to be in one of an ON state and an OFF state, and a signal electrode for applying a voltage in accordance with image data to the display medium, all of which are provided on the other substrate of the pair of substrates, the method comprising the steps of:

driving the common electrode by a first driving voltage signal represented by a first function which indicates a waveform of a voltage for driving the common electrode and uses time as a variable;

differentiating the first driving voltage signal with respect to time;

differentiating with respect to time a second driving voltage signal represented by a second function which indicates a waveform of a voltage for driving the scanning electrode and uses time as a variable; and adjusting the second driving voltage applied to the scanning electrode so that a primary differential of the first function and a primary differential of the second function are equal to each other when the switching element is in the OFF state.

2. A method for driving a display device including:

a display medium;

a pair of substrate opposed to each other and interposing the display medium therebetween;

a common electrode provided on one of the pair of substrates;

a switching element, a scanning electrode for applying a voltage for controlling the switching element to be in one of an ON state and an OFF state, and a signal electrode for applying a voltage in accordance with image data to the display medium, all of which are provided on the other substrate of the pair of substrates;

a storage capacitor provided electrically parallel to the display medium; and a storage capacitance electrode for applying a voltage to the storage capacitor, the method comprising the steps of:

driving the common electrode by a voltage represented by a first function which indicates a waveform of a voltage for driving the common electrode and uses time as a variable;

driving the scanning electrode by a voltage represented by a second function which indicates a waveform of a voltage for driving the scanning electrode and uses time as a variable;

driving the storage capacitance electrode by a voltage represented by a third function which indicates a waveform of a voltage for driving the storage capacitance electrode and uses times as a variable; and adjusting the voltages applied to the common, scanning, and storage capacitance electrodes so that a primary differential of the first function, a primary differential of the second function, and a primary differential of the third function are equal to one another when the switching element is in the OFF state.

3. A method for driving a display device according to claim 2, wherein the adjusting step includes the steps of:

detecting the voltage applied to one of the common electrode, the scanning electrode, and the storage capacitance electrode; and equalizing the voltage for driving the one of the common electrode, the scanning electrode, and the storage capacitance electrode with the voltage applied to the one of the common electrode, the scanning electrode, the storage capacitance electrode; based on the detected voltage.

4. A circuit for driving a display device, comprising:

a display medium;

a pair of substrate opposed to each other and interposing the display medium therebetween;

a common electrode provided on one of the pair of substrates;

a switching element, a scanning electrode for applying a voltage for controlling the switching element to be in one of an ON state and an OFF state, and a signal electrode for applying a voltage in accordance with image data to the display medium, all of which are provided on the other substrate of the pair of substrates;

common electrode driving means for providing a first driving voltage signal having a waveform represented by a first function which uses time as a variable to the common electrode;

first primary differential means for receiving the first driving voltage signal and for differentiating the first driving voltage signal with respect to time;

second primary differential means for receiving a second driving voltage signal and for differentiating with respect to time the second driving voltage signal having a waveform represented by a second function which uses time as a variable; and scanning electrode driving means for receiving the differentiated first driving voltage signal and the differentiated second driving voltage signal, and for generating the second driving voltage signal to equalize the differentiated first driving voltage signal with the differentiated second driving voltage signal.

5. A circuit for driving a display device according to claim 4, wherein the first and second primary differential means include a CR differentiation circuit.

* * * * *